United States Patent [19]

Suzuki

[11] Patent Number: 4,590,338

[45] Date of Patent: May 20, 1986

[54] SWITCH FOR ADJUSTABLY TILTING MIRROR MEMBERS OF OUTER MEMBERS

[75] Inventor: Masaru Suzuki, Chiryu, Japan

[73] Assignee: Kabushiki Kaisha Tokai Rika Denki Seisakusho, Aichi, Japan

[21] Appl. No.: 631,224

[22] Filed: Jul. 16, 1984

[30] Foreign Application Priority Data

Jul. 16, 1983 [JP] Japan ..... 58-110766[U]

[51] Int. Cl.[4] ..... H01H 3/00

[52] U.S. Cl. ..... 200/5 R; 200/6 R; 200/16 R; 200/18

[58] Field of Search ..... 200/1 V, 5 R, 4, 18, 200/153 K, 339, 6 A, 6 R, 16 R

[56] References Cited

U.S. PATENT DOCUMENTS 4,428,649 1/1984 Main et al. ..... 200/6 A X

FOREIGN PATENT DOCUMENTS 56-17633 2/1981 Japan .

*Primary Examiner*—A. D. Pellinen
*Assistant Examiner*—Morris Ginsburg
*Attorney, Agent, or Firm*—Jackson & Jones

[57] ABSTRACT

A switch for adjustably tilting a mirror member of each of a pair of right and left outer mirrors of a motor vehicle in upward, downward, rightward and leftward directions. The switch includes a switch casing, a changeover switch for selecting one of the outer mirrors and an operating switch for adjustably tilting the mirror member of the selected one of the outer mirrors such that a changeover switch knob of the changeover switch is movably tilted in an opening formed at a central portion of an operating switch knob of the operating switch. The operating switch knob is formed with an inner peripheral face and an outer peripheral face such that a lower end of the inner peripheral face is disposed more adjacent to a bottom wall of the switch casing than that of the outer peripheral face.

7 Claims, 12 Drawing Figures

| Terminal / Changeover | MV | VL | VR | MH | HL | HR |
|---|---|---|---|---|---|---|
| Left Mirror | ○ | ○ | | ○ | ○ | |
| Right Mirror | ○ | | ○ | ○ | | ○ |

| Terminal / Changeover | MV | MH | B | E | C |
|---|---|---|---|---|---|
| Up | ○ | | ○ | ○ | ○ |
| Down | ○ | | | ○ | ○ |
| L (Left) | | ○ | ○ | ○ | ○ |
| R (Right) | | ○ | ○ | ○ | ○ |

SWITCH FOR ADJUSTABLY TILTING MIRROR MEMBERS OF OUTER MEMBERS

BACKGROUND OF THE INVENTION

The present invention generally relates to a motor vehicle and more particularly, to a switch for adjustably tilting a mirror member of each of a pair of right and left outer mirrors of the motor vehicle in upward, downward, rightward and leftward directions, (referred to as a "mirror switch", hereinbelow), which includes a changeover switch for selecting one of the right and left outer mirrors and an operating switch for adjustably tilting the mirror member of the selected one of the right and left outer mirrors in the upward, downward, rightward and leftward directions.

Conventionally, various mirror switches of this kind are known. One example of the prior art mirror switches is shown in FIGS. 1 and 2 in which a sliding type changeover switch knob 2 for selecting one of a pair of right and left outer mirrors and a tilting type operating switch knob 3 for adjustably tilting the mirror member of the selected one of the right and left outer mirrors in upward, downward, rightward and leftward directions are disposed independently of each other in a switch casing 1. The operating switch knob 3 has a spherical portion 3*a* provided at a central portion thereof and acting as its tilting fulcrum and four push plate portions 3*b* extending from the spherical portion 3*a* in upward, downward, rightward and leftward directions of the spherical portion 3*a*, respectively such that the push plate portions are, respectively, used for tilting the mirror member in the upward, downward, rightward and leftward directions. The operating switch knob 3 is at all times urged by a spring 4 so as to be maintained in a neutral position. The spherical portion 3*a* is tiltably received by a spherical bearing portion 1*a* formed in the switch casing 1 so as to be tilted in the above described four directions. Meanwhile, a contact holder 6 supporting movable contacts 5 provided for the four push plate portions 3*b*, respectively is disposed below the spherical portion 3*a* and on a substrate 8 constituting a bottom wall 9 of the switch casing 1. Fixed contacts 7 operatively associated with the movable contacts 5 of the operating switch knob 3, respectively and other fixed contacts (not shown) operatively associated with another movable contact (not shown) disposed below the changeover switch knob 2 are provided on the substrate 8. Accordingly, when any one of the push plate portions 3*b* is depressed after either one of the right and left outer mirrors has been selected by the changeover switch knob 2, the movable contact 5 of the depressed one of the push plate portions 3*b* is brought into contact with a corresponding one of the fixed contacts 7, so that a drive circuit for driving the mirror member of the selected one of the right and left outer mirrors is closed and thus, the mirror member is tilted in the direction corresponding to the depressed one of the push plate portions 3*b*.

Meanwhile, although the mirror switch is generally mounted on an instrument panel of the motor vehicle, the instrument panel is further provided with various indicators, operating members, etc. Accordingly, it is desirable that the mirror switch be made as compact in size as possible. Consequently, in order to make the mirror switch compact, it is desirable that the changeover switch knob 2 and the operating switch knob 3 which are disposed separately from each other in the known mirror switch as described above be integrally combined with each other.

However, in the above described arrangement of the known mirror switch, since the push plate portions 3*b* are tilted in the four directions such that the spherical portion 3*a* provided at the central portion of the operating switch knob 3 acts as the tilting fulcrum, it is impossible to provide the changeover switch knob 2 at the central portion of the operating switch knob 3. Thus, the prior art mirror switch has such a disadvantage that, since the operating switch knob 3 and the changeover switch knob 2 are required to be disposed separately from each other, it becomes inevitably necessary to secure a large space for mounting the mirror switch on the instrument panel.

SUMMARY OF THE INVENTION

Accordingly, an essential object of the present invention is to provide an improved mirror switch in which a changeover switch knob is disposed at a central portion of an operating switch knob and the central portion of the operating switch knob act as a tilting fulcrum of the operating switch knob so as to be made compact in size, with substantial elimination of the disadvantages inherent in conventional mirror switches of this kind.

Another important object of the present invention is to provide an improved mirror switch of the above described type which is highly reliable in actual use.

In accomplishing these and other objects according to one preferred embodiment of the present invention, there is provided an improved switch for adjustably tilting a mirror member of each of a pair of right and left outer mirrors in upward, downward, rightward and leftward directions, comprising: a switch casing including a peripheral wall and a bottom wall; a changeover switch means for selecting one of said right and left outer mirrors, said changeover switch means including a changeover switch knob, at least one first movable contact member actuated through operation of said changeover switch knob, and at least two first fixed contact members which are, respectively, disposed at predetermined positions on an upper face of said bottom wall so as to be operatively associated with said first movable contact member; an operating switch means for adjustably tilting said mirror member of said selected one of said right and left outer mirrors in the upward, downward, rightward and leftward directions, said operating switch means including an operating switch knob having a plate member formed with four push plate portions extending from a central portion of said plate member in upward, downward, rightward and leftward directions of said plate member, respectively, at least four second movable contact members, an elastic member which urges said plate member towards a neutral position of said plate member, and at least four second fixed contact members which are, respectively, operatively associated with said second movable contact members; said changeover switch means and said operating switch means being provided in said switch casing; said plate member having a through-opening formed at said central portion such that said changeover switch knob is movably fitted in said through-opening; said push plate portions each being formed with an inner peripheral face surrounding said changeover switch knob and an outer peripheral face disposed outwardly of said inner peripheral face such that a lower end portion of said inner peripheral face is disposed more adjacent to said bottom wall than that of said outer peripheral face when said plate member is in said neutral position, whereby when one of said push plate portions is depressed, a corresponding lower end portion of said inner peripheral face of such depressed one of said push plate portions is brought into contact with said bottom wall so as to act as a tilting fulcrum for said operating switch knob such that said operating switch knob as a whole is tilted about said tilting fulcrum, so that one of such second movable contact members corresponding to said depressed one of said push plate portions is brought into contact with a corresponding one of said second fixed contact members and thus, said mirror member of said selected one of said right and left outer mirrors is tilted in one of the upward, downward, rightward and leftward directions corresponding to said depressed one of said push plate portions.

In accordance with the present invention, since the changeover switch knob is disposed at the central portion of the operating switch knob, operational efficiency of the mirror switch is improved and space required for mounting the mirror switch on the instrument panel is reduced in comparison with the prior art mirror switches in which the operating switch knob and the changeover switch knob are provided separately from each other.

Furthermore, in accordance with the present invention, since the operating switch knob as a whole is tilted with the corresponding lower end portion of the inner peripheral face of the depressed one of the push plate portions as the tilting fulcrum, it becomes possible to smoothly tilt the operating switch knob selectively in the upward, downward, rightward and leftward directions.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
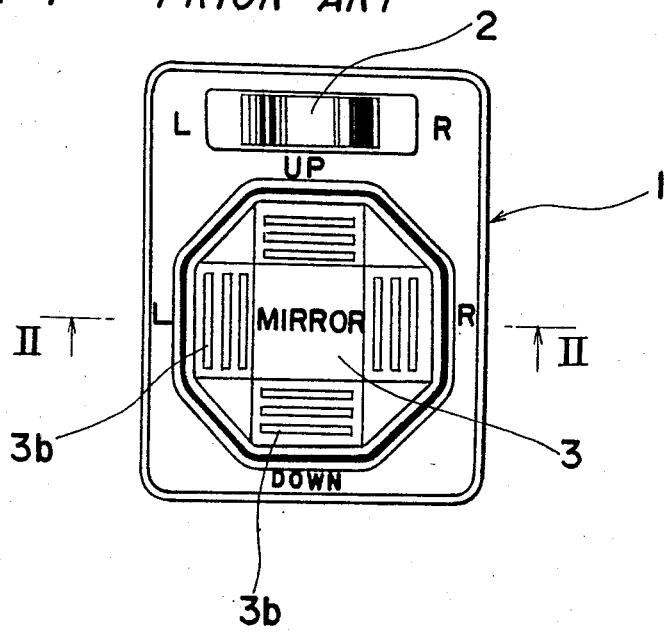
Fig. 1 PRIOR ART
FIG. 1 is a front elevational view of a prior art mirror switch.
Figure 2:
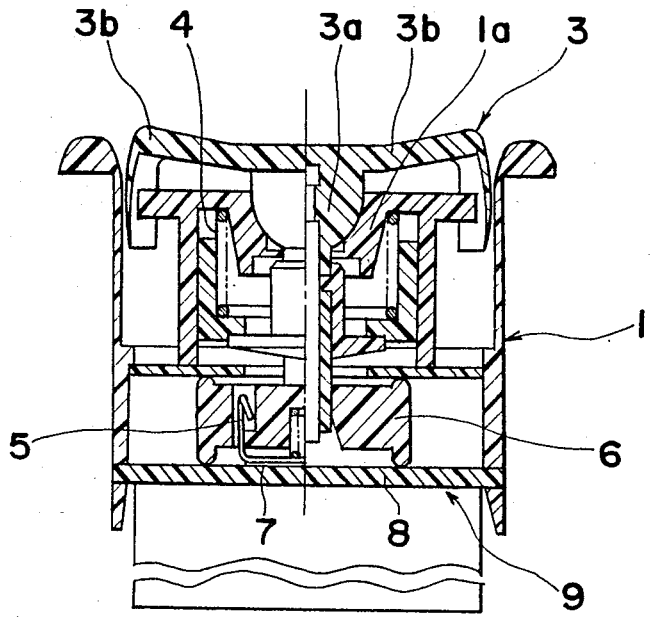
Fig. 2 PRIOR ART
FIG. 2 is a cross-sectional view taken along the line II—II in FIG. 1.
Figure 3:
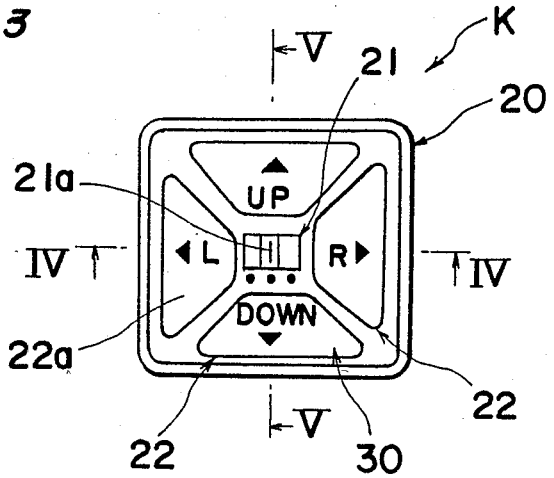
FIG. 3 is a front elevational view of a mirror switch according to one preferred embodiment of the present invention.
Figure 4:
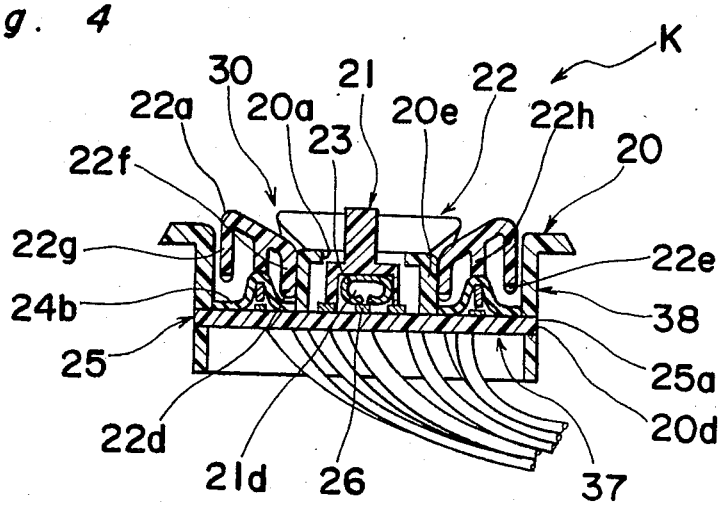
FIG. 4 is a cross-sectional view taken along the line IV—IV in FIG. 3.
Figure 5:
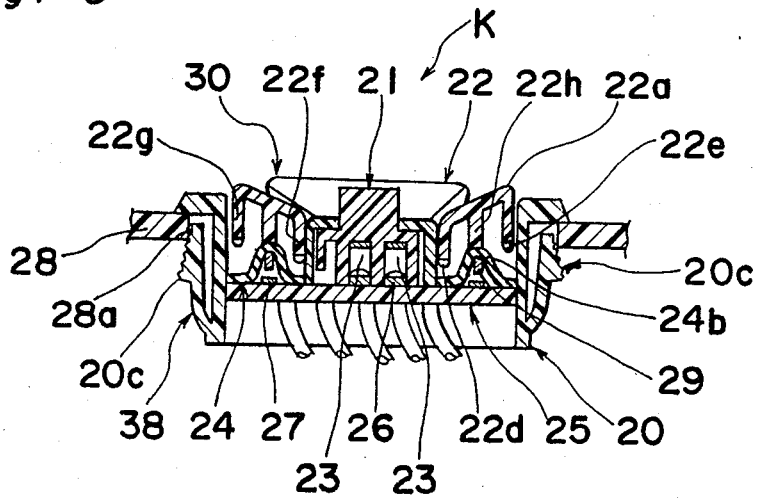
FIG. 5 is a cross-sectional view taken along the line V—V in FIG. 3.
Figure 6:
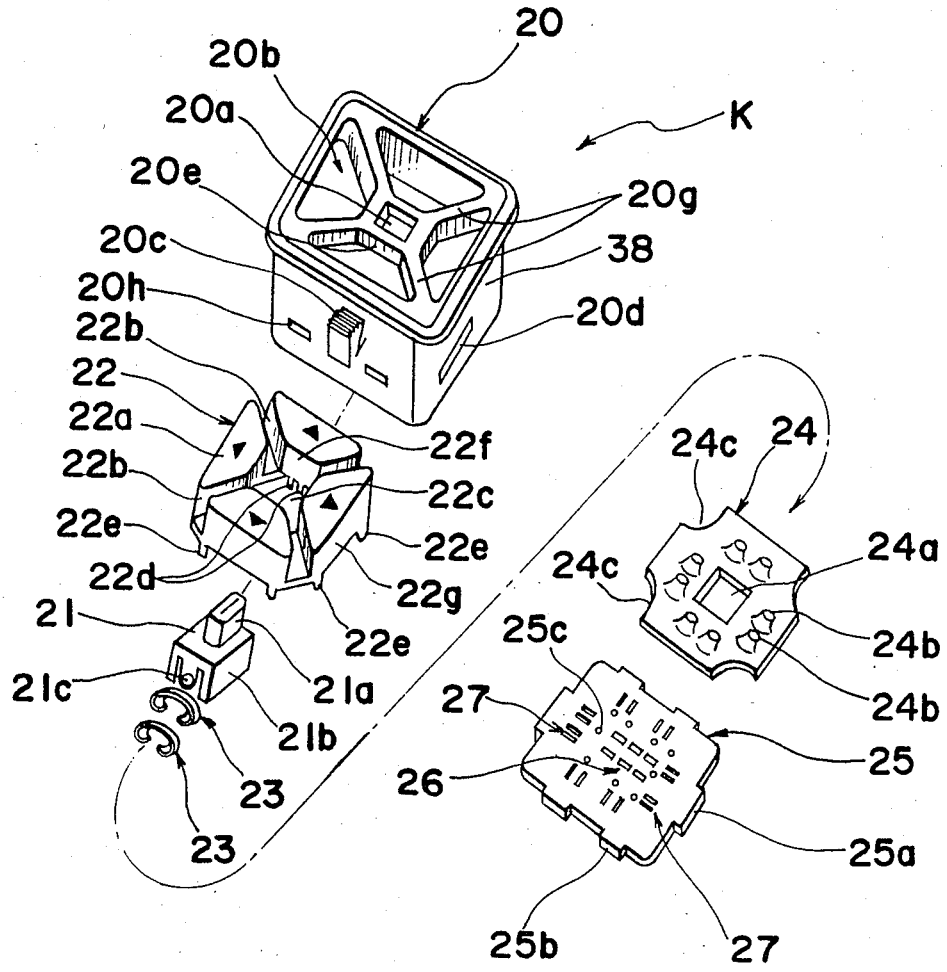
FIG. 6 is an exploded perspective view of the mirror switch of FIG. 3.

Referring now to the drawings, there is shown in FIGS. 3 to 12, a mirror switch K for adjustably tilting a mirror member of each of a pair of right and left mirrors of a motor vehicle in upward, downward, rightward and leftward directions, according to one preferred embodiment of the present invention. As shown in FIG. 6, the mirror switch K generally includes a switch casing 20, a changeover switch knob 21 for selecting one of the right and left outer mirrors, a rectangular substrate 25 acting as a bottom wall 37 of the switch casing 20 and an operating switch knob 30 for adjustably tilting the mirror member of the selected one of the right and left outer mirrors in the upward, downward, rightward and leftward directions. The operating switch knob 30 is tiltably provided in the switch casing 20 so as to be tilted in upward, downward, rightward, and leftward directions as shown in FIG. 3, while the substrate 25 is provided below the operating switch knob 30 in the switch casing 20. The operating switch knob 30 is constituted by a rectangular knob body 22, a rectangular movable contact holder 24 acting as a spring means for urging the knob body 22 to its neutral position and a plurality of movable contacts 29 supported by the movable contact holder 24. The movable contacts 29 are, respectively, brought into contact, upon tilting of the knob body 22, with a plurality of fixed contacts 27 provided on the substrate 25, while the changeover switch knob 21 is slidably provided at a central portion of the operating switch knob 30.

As shown in FIGS. 4 to 6, the switch casing 20 has a boxlike shape including a peripheral wall 38 and the bottom wall 37, i.e. the substrate 25. The switch casing 20 further includes a rectangular central rib **20*e* formed at a central portion thereof and four diagonal ribs 20*g* diagonally extending from four vertexes thereof to the central rib 20*e*, respectively such that four trapezoidal through-holes 20*b* are defined around the central rib 20*e* between adjacent ones of the diagonal ribs 20*g* and between the central rib 20*e* and the peripheral wall 38 in upward, downward, rightward and leftward directions of the central rib 20*e*, respectively. An upper face of the central rib 20*e* is recessed downwardly of that of the peripheral wall 38. A rectangular through-opening 20*a* is formed in the central rib 20*e* such that the changeover switch knob 21 is slidably fitted in the through-opening 20*a*. Furthermore, a pair of elastic engaging pawls 20*c* are formed on a pair of opposite outer faces of the peripheral rib 38 such that the switch casing 20 is mounted on a mounting plate 28 through engagement of the engaging pawls 20*c* with a fitting hole 28*a* of the mounting plate 28**.

Figure 8:
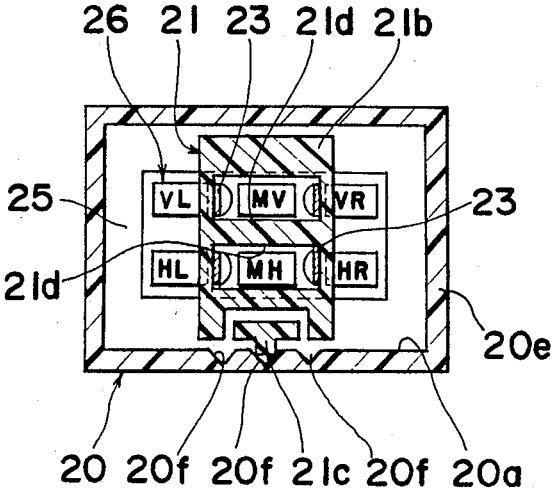
FIG. 8 is a transverse sectional view showing, on an enlarged scale, a changeover switch knob employed in the mirror switch of FIG. 3.

As described above, the changeover switch knob 21 is slidably fitted in the through-opening **20*a* of the switch casing 20. The changeover switch knob 21 includes a rectangular base portion 21*b* and an operating portion 21a formed on an upper face of the base portion 21b such that the operating portion 21a projects upwardly out of the through-opening 20a. Meanwhile, as shown in FIG. 8, an elastic detent projection 21c is integrally formed on one side face of the base portion 21b. The detent projection 21c is selectively brought into engagement with three grooves 20f formed on one inner face of the central rib 20e such that the changeover switch knob 21 is selectively displaced to a left position for selecting the left outer mirror, an intermediate position, i.e. a neutral position and a right position for selecting the right outer mirror. The base portion 21b is formed, at a lower face thereof, with two slots 21d such that two movable contacts 23 are, respectively, press fitted into the slots 21d. Each of the movable contacts 23 is made of an elastic material and has a pair of opposite curved end portions extending downwardly such that the curved end portions are brought into and out of sliding contact with fixed contacts 26 provided on the substrate 25**.

Four push plate portions 22a for tilting the mirror member of the selected one of the right and left outer mirrors in the upward, downward, rightward and leftward directions, respectively are, respectively, formed on upper, lower, right and left portions of an upper face of the knob body 22. The knob body 22 further has a rectangular through-opening 22c formed at a central portion thereof and four diagonal slots 22b diagonally extending from four vertexes of the knob body 22 to the through-opening 22c, respectively. The push plate portions 22a are, respectively, loosely fitted into the through-holes 20b, while the central rib 20e of the switch casing 20 is loosely fitted into the through-opening 22c such that the diagonal ribs 20g are, respectively, fitted into the diagonal slots 22b. Each of the push plate portions 22a has an inner wall face 22f and an outer wall face 22g. A lower end of the inner wall face 22f is disposed more adjacent to the substrate 25 than the outer wall face 22g. The inner wall face 22f is formed, at the lower end thereof, with a pair of projections 22d, while the outer wall face 22g is formed, at the lower end thereof, with a pair of projections 22e. It is to be noted that the projections 22d are disposed more adjacent to the substrate 25 than the projections 22e. Thus, when one of the push plate portions 22a is depressed into the switch casing 20, the projections 22d of the depressed one of the push plate portions 22a come into contact with the substrate 25 so as to lower the corresponding projections 22e with the projections 22d as a tilting fulcrum, whereby the knob body 22 as a whole is tilted about the tilting fulcrum with respect to the switch casing 20. Moreover, each of the push plate portions 22a has a pressing portion 22h formed between the inner wall face 22f and the outer wall face 22g such that the pressing portion 22h brings the movable contacts 29 into and out of contact with the fixed contacts 27 on the substrate 25 as will be described later.

Figure 7:
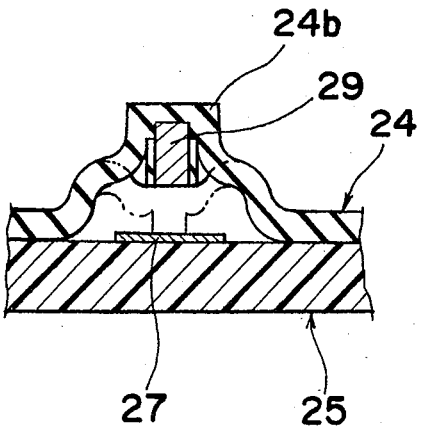
FIG. 7 is a fragmentary vertical sectional view showing, on an enlarged scale, a movable contact holder employed in the mirror switch of FIG. 3.

The rectangular movable contact holder 24 acting as a spring means is made of rubber and is placed below the knob body 22 and on the substrate 25. The movable contact holder 24 has a rectangular opening 24a formed at a central portion thereof, whereby the changeover switch knob 21 is slidably moved in the opening 24a and the projections 22d of the inner wall face 22f of the knob body 22 are allowed to come into contact with the substrate 25. The movable contact holder 24 has four arcuate cutouts 24c formed at four vertexes thereof, respectively so as to allow the projections 22e of the outer wall face 22g of the knob body 22 to come into contact with the substrate 25 such that further tilting of the knob body 22 is regulated. Four pairs of eight protrusions 24b for accommodating the movable contacts 29, respectively are formed on an upper face of the movable contact holder 24 such that one pair of the two protrusions 24b coact with each pressing portion 22h of the knob body 22. As best shown in FIG. 7, each of the movable contacts 29 is supported at a lower face of each of the protrusions 24b. Accordingly, since the knob body 22 is at all times urged toward its neutral position by the movable contact holder 24 through contact of the protrusions 24b with the pressing portions 22h, the movable contacts 29 are spaced away from the fixed contacts 27 and, at the same time, the projections 22d and 22e of the knob body 22 are spaced away from the substrate 25. Meanwhile, when the knob body 22 is tilted by depressing one of the push plate portions 22a one of the pressing portions 22h corresponding to the depressed one of the push plate portions 22a depresses a corresponding pair of the two protrusions 24b downwardly against an elastic force of the protrusions 24b as shown in the two-dot chain lines in FIG. 7, so that a corresponding pair of the two movable contacts 29 are brought into contacts with corresponding ones of the fixed contacts 27 provided on the substrate 25.

Figure 9:
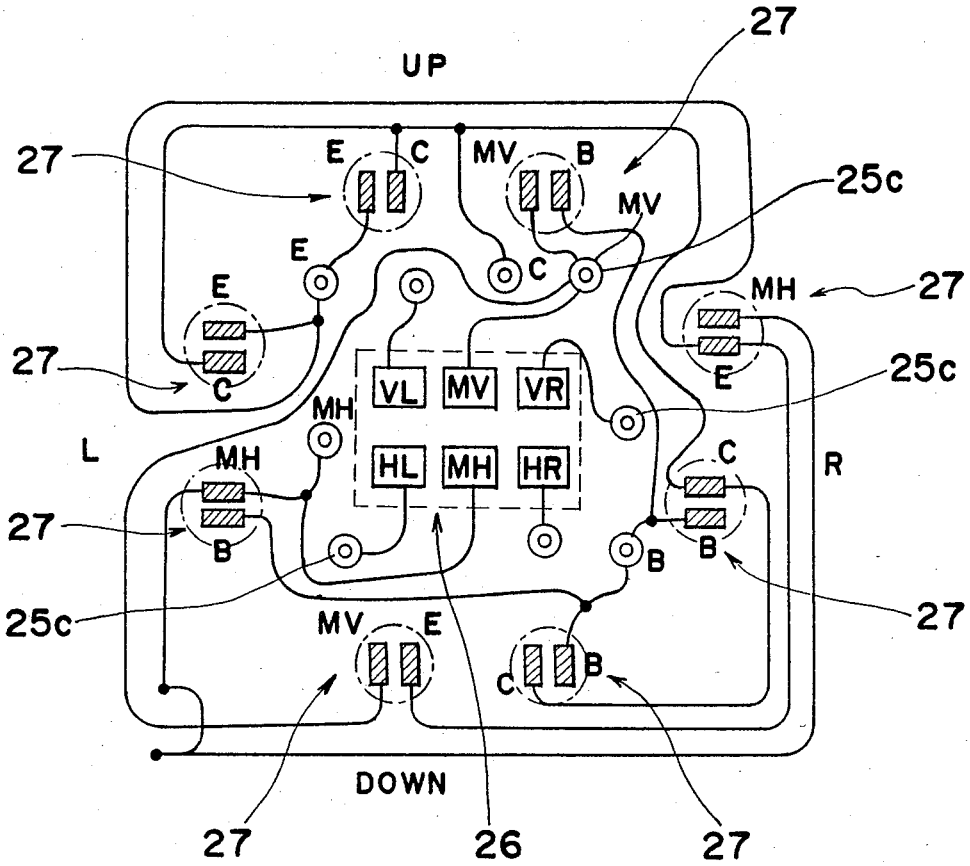
FIG. 9 is an electrical circuit diagram of printed wiring of a substrate employed in the mirror switch of FIG. 3.
Figures 10, 11, 12:
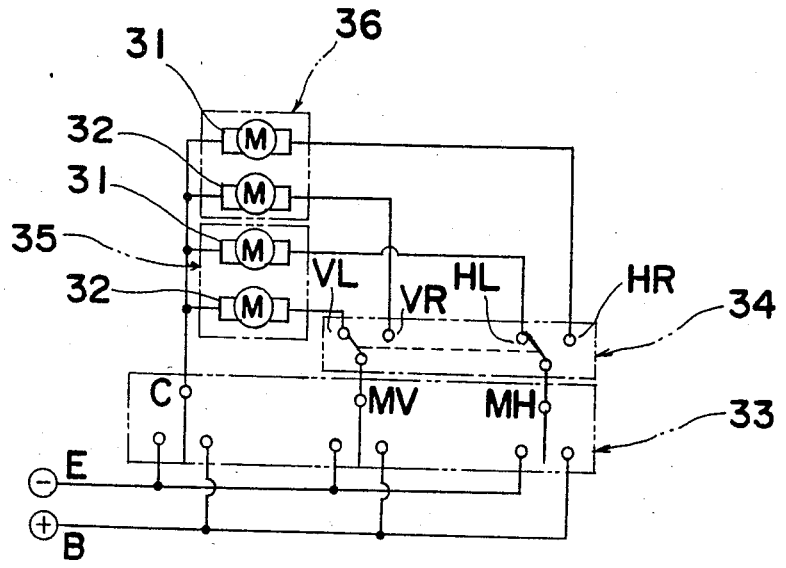
FIG. 10 is an electrical circuit diagram of an operating switch, a changeover switch and motors employed in the mirror switch of FIG. 3.
FIG. 11 is a table explanatory of connection of terminals connected to fixed contacts of the changeover switch of FIG. 10.
FIG. 12 is a table explanatory of connection of terminals connected to fixed contacts of the operating switch of FIG. 10.

The substrate 25 is made of insulating material and has a pair of lugs 25a formed at one pair of opposite side edges, respectively and two pairs of lugs 25b formed at the other pair of opposite side edges, respectively. The switch casing 20 has a pair of slots 20d formed at lower portions of a pair of opposite sides of the peripheral wall 38 and two pairs of slots 20h formed at lower portions of the other pair of opposite sides of the peripheral wall 38 such that the substrate 25 is retained by the switch casing 20 through engagement of the lugs 25a with the slots 20d, respectively and through engagement of the lugs 25b with the slots 20h, respectively. As shown in FIG. 9, a plurality of the fixed contacts 26 and 27 are provided on an upper face of the substrate 25 and the fixed contacts 26 and 27 are connected to each other properly by printed wiring. Namely, a total of the six fixed contacts 26, i.e. VL, MV, VR, HL, MH and HR are provided at a central portion of the upper face of the substrate 25. As shown in FIGS. 10 and 11, when the fixed contacts MV and MH are, respectively, connected to the fixed contacts VL and HL through the movable contacts 23, the left outer mirror is selected. On the other hand, when the fixed contacts MV and HR are, respectively, connected to the fixed contacts VR and MH through the movable contacts 23, the right outer mirror is selected.

Furthermore, a total of the eight fixed contacts 27 each having two contact portions are provided around the fixed contacts 26 so as to coact with the movable contacts 29 of the movable contact holder 24, respectively. More specifically, the fixed contact 27 having contact portions MV and B and the fixed contact 27 having contact portions E and C are provided above the fixed contacts 26, while the fixed contact 27 having contact portions MV and E and the fixed contact 27 having contact portions B and C are provided below the fixed contacts 26. Meanwhile, the fixed contact 27 having contact portions MH and B and the fixed contact 27 having contact portions E and C are provided at the left side of the fixed contacts 26, while the fixed contact 27 having contact portions MH and E and the fixed contact 27 having contact portions B and C are provided at the right side of the fixed contacts 26. As shown in FIGS. 10 and 12, when the contact portions MV and E are, respectively, connected to the contact portions B and C, a motor 32 for driving the mirror member in the upward and downward directions is rotated forwardly so as to drive the mirror member in the upward direction. On the contrary, when the contact portions MV and B are, respectively, connected to the contact portions E and C, the motor 32 is rotated reversely so as to drive the mirror member in the downward direction. Meanwhile, when the contact portions MH and E are, respectively, connected to the contact portions B and C, a motor 31 for driving the mirror member in the rightward and leftward directions is rotated forwardly so as to drive the mirror member in the leftward direction. On the contrary, when the contact portions MH and B are, respectively, connected to the contact portions E and C, the motor 31 is rotated reversely so as to drive the mirror member in the rightward direction. In FIGS. 6 and 9, reference numeral 25*c* represents a hole for mounting a terminal therethrough. In FIG. 10, reference numerals 33, 34, 35 and 36 represent an operating switch, a changeover switch, the motors 31 and 32 for the left outer mirror and the motors 31 and 32 for the right outer mirror, respectively.

Hereinbelow, operations of the mirror switch K will be described. Initially, the changeover switch knob 21 is slid from the neutral position to, for example, the left position for selecting the left outer mirror. Subsequently, when a desired one of the push plate portions 22*a*, for example, the upper push plate portion 22*a* is depressed into the switch casing 20, the two projections 22*d* of the inner wall face 22*f* of the depressed upper push plate portion 22*a* come into contact with the substrate 25 so as to act as a tilting fulcrum such that the knob body 22 as a whole is tilted about the tilting fulcrum until the two projections 22*e* of the outer wall face 22*g* of the depressed upper push plate portion 22*a* come into contact with the substrate 25. Upon this tilting of the knob body 22, two corresponding ones of the protrusions 24*b* of the movable contact holder 24 are depressed downwardly toward the substrate 25 by the pressing portion 22*h* of the depressed upper push plate portion 22*a*, so that the two movable contacts 29 of the two corresponding protrusions 24*b* come into contact with the fixed contact 27 having the contact portions MV and B and the fixed contact 27 having the contact portions E and C, respectively and thus, the contact portions MV and E are, respectively, electrically conducted to the contact portions B and C, whereby the mirror member of the left outer mirror is tilted in the upward direction. Thereafter, when the lower, right and left push plate portions 22*a* are selectively depressed, the mirror member of the left outer mirror can be tilted in the downward, rightward and leftward directions, respectively. When the changeover switch knob 21 is displaced to the right position for selecting the right outer mirror, it becomes possible to tilt the mirror member of the right outer mirror in the upward, downward, rightward and leftward directions in the same manner as described above.

In accordance with the present invention, since the changeover switch knob 21 is slidably provided at the central portion of the knob body 22 of the operating switch knob 30 without deterioration of operational efficiency of the operating switch knob 30, the changeover switch knob 21 and the operating switch knob 30 can be mounted in a small space required for mounting of the operating switch knob 30 only. Furthermore, since the changeover switch knob 21 and the operating switch knob 30 are disposed in a concentrated manner, they can be operated easily.

In accordance with the present invention, all the projections 22*d* of the inner wall faces 22*f* of the knob body 22 are spaced upwardly from the substrate 25 at the time of the neutral position of the knob body 22. Subsequently, when one of the push plate portions 22*a* of the knob body 22 is depressed into the switch casing 20, the two projections 22*d* of the inner wall face 22*f* of the depressed one of the push plate portions 22*a* are brought into contact with the substrate 25 so as to act as the tilting fulcrum such that the two projections 22*e* of the outer wall face 22*g* of the depressed one of the push plate portions 22*a* is depressed downwardly, so that a tilting angle of the push plate portions 22*a* is relatively small and thus, it becomes possible to set a play between the switch casing 20 and the knob body 22 at a small value.

Furthermore, in accordance with the present invention, since it is so arranged that the operating switch knob 30 cannot be tilted in two directions at a time but can be tilted only in one direction at a time, short-circuiting due to tilting of the operating switch knob 30 in two directions at a time can be prevented.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A switch for adjustably tilting a mirror member of each of a pair of right and left outer mirrors in upward, downward, rightward and leftward directions, comprising:

a switch casing including a peripheral wall and a bottom wall;

a changeover switch means for selecting one of said right and left outer mirrors, said changeover switch means including a changeover switch knob, at least one first movable contact member actuated through operation of said changeover switch knob, and at least two first fixed contact members which are, respectively, disposed at predetermined positions on an upper face of said bottom wall so as to be operatively associated with said first movable contact member;

an operating switch means for adjustably tilting said mirror member of said selected one of said right and left outer mirrors in the upward, downward, rightward and leftward directions, said operating switch means including an operating switch knob having a plate member formed with four push plate portions extending from a central portion of said plate member in upward, downward, rightward and leftward directions of said plate member, respectively, at least four second movable contact members, an elastic member which urges said plate member toward a neutral position of said plate member, and at least four second fixed contact member which are, respectively, operatively associated with said second movable contact members;

said changeover switch means and said operating switch means being provided in said switch casing;

said plate member having a through-opening formed at said central portion such that said changeover switch knob is movably fitted in said through-opening;

said push plate portions each being formed with an inner peripheral face surrounding said changeover switch knob and an outer peripheral face disposed outwardly of said inner peripheral face such that a lower end portion of said inner peripheral face is disposed more adjacent to said bottom wall than that of said outer peripheral face when said plate member is in said neutral position, whereby when one of said push plate portions is depressed, a corresponding lower end portion of said inner peripheral face of said depressed one of said push plate portions is brought into contact with said bottom wall so as to act as a tilting fulcrum for said operating switch knob such that said operating switch knob as a whole is tilted about said tilting fulcrum, so that one of said second movable contact members corresponding to said depressed one of said push plate portions is brought into contact with a corresponding one of said second fixed contact members.

2. A switch as claimed in claim 1, wherein each of said push plate portions has a pair of first projections formed at a lower end of said inner peripheral face.

3. A switch as claimed in claim 2, wherein each of said push plate portions has a pair of second projections formed at a lower end of said outer peripheral face.

4. A switch as claimed in claim 3, wherein each of said push plate portions has a pressing portion formed between said inner peripheral face and said outer peripheral face, said pressing portion being held in contact with said elastic member so as to depress each of said second movable contact members into contact with each of said second fixed contact members when each of said push plate portions is depressed.

5. A switch as claimed in claim 1, wherein said elastic member is made of rubber and is formed with at least four protrusions for accommodating said second movable contact members therein, respectively.

6. A switch as claimed in claim 4, wherein said elastic member is made of rubber and is formed with at least four protrusions for accommodating said second movable contact members therein, respectively.

7. A switch for controlling a multi-mode operation comprising:

a switch casing having an upper rib structure providing a central opening and four peripheral openings spaced respectively by four diagonal ribs;

a knob body mounted in the switch casing with a quadrifed push plate, the push plate extending respectively into each of the peripheral openings and having lower extensions to provide a tilting fulcrum for the push plate during a switching operation;

a changeover switch mechanism mounted in the central opening of the switch casing to connect the push plate with at least one set of a plurality of electrical contact sets;

a first set of electrical contacts mounted on a resilient movable contact holder in the switch casing and operatively positioned adjacent the bottom of the knob body, a second set of electrical contacts is mounted on a substrate beneath the movable contact holder, whereby depression of the push plate provides a tilting movement to activate at least a first electrical contact with a pair of second electrical contacts to activate one of the modes of operation.

* * * * *